United States Patent [19]

Matsumura et al.

[11] 4,441,965

[45] Apr. 10, 1984

[54] CODEPOSITION METHOD

[75] Inventors: Sowjun Matsumura, Toyonaka; Ken Araki, Ibaragi; Tetsuo Otaka, Kashiwa; Masumi Tanigawa, Hirakata, all of Japan

[73] Assignee: C. Uyemura & Co., Ltd., Osaka, Japan

[21] Appl. No.: 496,396

[22] Filed: May 20, 1983

[30] Foreign Application Priority Data

May 21, 1982 [JP] Japan ..... 57-87076

[51] Int. Cl.[3] ..... C25D 15/02

[52] U.S. Cl. ..... 204/16; 204/273

[58] Field of Search ..... 204/16, 273

[56] References Cited

U.S. PATENT DOCUMENTS 3,061,525 10/1962 Grazen ..... 204/16

3,830,711 8/1974 Kedward ..... 204/273

4,240,880 12/1980 Tsuchibuchi ..... 204/15

*Primary Examiner*—T. M. Tufariello

*Attorney, Agent, or Firm*—Birch, Stewart, Kolasch & Birch

[57] ABSTRACT

A method for codepositing a water-insoluble material with a metal from a plating solution having the metal ion dissolved and the water-insoluble material suspended therein, characterized by pumping at least one third per minute of the volume of the plating solution by means of a pump without entraining air bubbles, and injecting the thus pumped volume downward into the bath through a plurality of holes in the lower side of a sparger pipe connected to said pump and located at a lower level in a plating tank, thereby circulating and fluidizing the plating solution in which codeposition is being carried out.

9 Claims, 4 Drawing Figures

CODEPOSITION METHOD

BACKGROUND OF THE INVENTION

The present invention relates to a method for codepositing water-insoluble materials such as inorganic or organic particles or short fibers in metal deposits.

It was proposed in the past to codeposit water-insoluble materials such as organic or inorganic particles in metal deposits in order to impart to them certain properties such as water resistance, lubricity, and adhesion.

In such codeposition methods, particularly, when reduced to commercial practice, it is desirable to ensure stable codeposition of water-insoluble materials. It is also desirable to codeposit water insoluble materials uniformly in a greater proportion with metal deposits. Although a proposal to this end has been made to use a special surface-active agent to suspend water-insoluble material in a plating solution, it is still necessary to ensure a more stable codeposition of water-insoluble material in metal deposits.

After extensive research, it has been found that a water-insoluble material can be codeposited with a metal in a very stable manner and in a greater proportion by carrying out deposition while circulating and fluidizing a plating solution having the metal ion dissolved therein and the water-insoluble material suspended therein by means of a pump. More specifically, the plating solution is circulated by the pump by pumping at least one third, preferably at least one-half of the volume of the plating solution per minute. A sparger pipe having a plurality of holes formed in its lower side is connected to the pump and disposed at a lower level in a tank. The pumped volume of the plating solution is injected downward into the solution through the sparger holes, and the plating solution is thus circulated and fluidized without entraining air bubbles.

In the prior art methods of codeposition, plating solutions having water-insoluble materials suspended therein are agitated by a variety of techniques including air agitation, mechanical agitation using, for example, an impeller agitator, and bath fluidization, for example, pumping circulation. Alternatively, workpieces themselves may be swung or vibrated in a plating solution. The inventors have found that agitation of a plating solution having water-insoluble materials suspended therein has a significant influence on the stable codeposition of the water-insoluble materials in the metal deposits. According to the inventors' experience, air agitation does not work well, particularly when a surface-active agent is added to a plating solution in order to more stably disperse water-insoluble materials in the solution. Codeposition becomes less stable because air bubbling causes foaming in the presence of a surface-active agent and such foams envelop the water-insoluble materials to reduce the quantity of the water-insoluble materials codeposited, which varies with different batches. The use of an impeller agitator often results in a unevenly fluidized plating bath. This in turn, results in a local variation in the quantity of the water-insoluble materials codeposited on the workpiece when a workpiece to be plated is of relatively large size, or a variation in the quantity of the water-insoluble materials codeposited among the workpieces when materials are codeposited concurrently on a plurality of workpieces. Further, the quantity of the water-insoluble materials codeposited substantially varies with the position of an impeller agitator relative to the position, orientation, and other dimensional factors of a workpiece to be plated, which causes less stable codeposition. Additionally, the quantity of the water-insoluble materials codeposited is relatively small. Further, the use of a pump for liquid circulation also suffers from a problem similar to the impeller agitator because the pump discharge opening must be critically positioned relative to the position, orientation, and dimensional factors of a workpiece. The technique of swinging or vibrating a workpiece in a plating bath also has a problem in decreasing the quantity of the water-insoluble materials codeposited. Under the circumstances, the inventors have studied a variety of agitation techniques to find that when codeposition is carried out from a plating solution having a metal ion dissolved and a water-insoluble material suspended therein, by pumping at least one third of the volume of the solution per minute by means of a pump without entraining air bubbles, and injecting the thus pumped volume downward into the solution through a plurality of holes in the lower side of a sparger pipe connected to the pump and located at a lower level in a tank, thereby circulating and fluidizing the plating solution, then highly stable codeposition is carried out in a reproduceable manner, and the quantity of the water-insoluble material codeposited is increased with a minimal variation. The present invention is based on this finding.

SUMMARY OF THE INVENTION

Therefore, it is an object of the present invention to provide a codepositing method in which a water-insoluble material is codeposited with a metal in a greater proportion with minimal variation.

According to the present invention, there is provided a method for codepositing a water-insoluble material with a metal from a plating solution having the metal ion dissolved and the water-insoluble material suspended therein, characterized by pumping at least one third per minute of the volume of the plating solution by means of a pump without entraining air bubbles, and injecting the thus pumped volume downward into the bath through a plurality of holes in the lower side of a sparger pipe connected to the pump and located at a lower level in a plating tank, thereby circulating and fluidizing the plating solution in which codeposition is being carried out.

In a preferred embodiment of the present invention, a water-insoluble organic high-molecular weight fluoride material is used as the water-insoluble material and dispersed in an electroplating bath containing at least one-half mole of sulfamate ion per liter of the bath, having added thereto a cationic fluorochemical surface-active agent or an amphoteric fluorochemical surface-active agent capable of exhibiting cationic nature in the bath. By using the plating bath which contains at least one-half mole of sulfamate ion and in which the cationic or amphoteric fluorochemical surface-active agent is added and the water-insoluble organic high-molecular weight fluoride material is dispersed, the quantity of the organic high-molecular weight material codeposited is increased and stable electro-codeposition may be carried out with a consistent quantity of organic material codeposited in the range of 10% to 50% by volume. Particularly when a plating bath used contains 0.5 to 3 moles of sulfamate ion, 0.1 to 10 grams per liter of the bath of the cationic or amphoteric fluorochemical surface-active agent, and 10 to 200 grams per liter of the bath of the organic high-molecular weight fluoride material, the organic high-molecular weight fluoride material can be codeposited in a quantity of 15% to 50% by volume, which value has not consistently been achieved by the conventional methods. In addition, the resulting codeposits are excellent in quality irrespective of such high percentage codeposition. Furthermore, the method of using the above-said plating bath ensures improved electro-codeposition with increased percentage codeposition even when either one of the cationic and amphoteric fluorochemical surface-active agents is used as a single surface-active agent, so that control of the plating bath is easy and agitation has little influence or uneven agitation does not always result in variations in the quantity of the organic material codeposited, resulting in easier control of the electroplating operation.

The above and other objects, features and advantages of the present invention will become more apparent and understandable from the following descriptions.

DETAILED EXPLANATION OF THE PREFERRED EMBODIMENT

Figure 1:
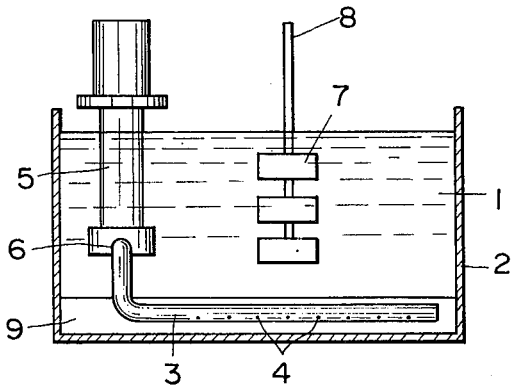
FIG. 1 is a side elevation of one embodiment of a system used in the practice of the present invention, illustrating the plating tank in cross section.

According to the codepositing method of the present invention, codeposition is carried out on workpieces in a plating solution having a metal ion dissolved and a water-insoluble material suspended therein, yielding a deposit having the water-insoluble material codeposited with the metal on the workpieces.

In the practice of the invention, a variety of water-insoluble material may be used including inorganic particles such as silica, silicon carbide, glass beads, glass powder, etc.; inorganic fibrous materials such as glass fibers and tungsten whiskers; organic particles such as particles of phenol resin, epoxy resin, polyamide resin, and rubber latex; and organic fibers such as polyester and polyamide fibers. The present method gives the best results particularly when combined with fluorinated organic or inorganic high-molecular weight materials.

Examples of the water-insoluble organic high-molecular weight fluoride materials include polytetrafluoroethylene, polychlorotrifluoroethylene, polyvinylidene fluoride, tetrafluoroethylene-hexafluoropropylene copolymers, tetrafluoroethylene-ethylene copolymers, chlorotrifluoroethylene-alkylene copolymers, vinylidene fluoride-hexafluoropropylene copolymers, vinylidene fluoride-chlorotrifluoroethylene copolymers, vinylidene fluoride-pentafluoropropylene copolymers, and other fluorocarbon resins in powder and short fiber forms.

Fluorinated graphite particles (CF)n are preferably used as a water-insoluble inorganic high-molecular weight fluoride material.

The water-insoluble particles may have 0.05–200 μm in an average diameter, and the water-insoluble fibers may have a length of 0.1–1000 μm, preferably 0.5–500 μm.

The above-listed water-insoluble materials may be added to the plating solution alone or in combination of two or more depending upon the intended purpose of plating. Although the dispersed amount of the water-insoluble material is not limited, the water-insoluble material may preferably be dispersed in the plating solution in amounts of 1 to 500 grams, especially 10 to 200 grams per liter of the solution.

Optionally, the water-insoluble materials may be pretreated on their surface such as by coating them with hydrophobic organic compounds.

In dispersing the water-insoluble material in a plating bath, surface-active agents including cationic, nonionic, amphoteric, and anionic surface-active agents or other dispersants may be used alone or in admixture of two or more to promote dispersion and suspension. The use of such a surface-active agent or dispersant is preferred because the water-insoluble material can be uniformly and stably dispersed in the plating bath, resulting in an increased quantity of the material codeposited.

The type of plating baths having a metal ion dissolved in which the above-mentioned water-insoluble materials are suspended is not particularly limited, and a suitable choice may be made to meet the purpose of the codepositing method. Examples of the plating baths include nickel electroplating baths such as Watts baths, high chloride baths, sulphamic acid baths, and borofluoride baths, in which nickel ions are dissolved. Other acidic and alkaline electroplating baths of cobalt, nickel alloy, zinc, tin, solder, iron, copper, and silver are also used. The method of the invention is also compatible with a variety of electroless plating baths.

When a water-insoluble organic high-molecular weight fluoride material is used as a water-insoluble material, a sulfamate bath may preferably be used as a plating bath. Codeposition rate of the organic fluoride material will increase by using the sulfamate bath.

The sulfamate bath preferably used for electro-codeposition of the organic fluoride polymer is now described in detail. A variety of metal ions may be added to the sulfamate plating bath including nickel, cobalt, copper and other metals, and accordingly, the organic high-molecular weight material is codeposited with nickel, cobalt, nickel-cobalt alloy, copper or the like. These metal ions may preferably be added to the sulfamate plating bath in amounts of 0.5 to 3 moles, especially 1 to 2.5 moles per liter of the bath. The plating bath contains sulfamate ion. More specifically, the plating bath may contain at least 0.5 moles, preferably at least 0.8 moles of sulfamate ion per liter of the bath. If the amount of sulfamate ion is less than 0.5 moles per liter of the bath, the effect of sulfamate ion to increase the quantity of organic high-molecular weight fluoride material codeposited may not be developed to such an extent. The upper limit of the amount of sulfamate ion is preferably on the order of 3 moles, though not strictly defined. The sulfamate ion may be added to the plating bath in the form of sulfamic acid (while the metal ion may be added in the form of sulfate, chloride or the like), or alternatively, added in the form of metal salts of sulfamic acid such as nickel sulfamate. It is also permissible for a part of the sulfamate ion to be composed of sulfamic acid and for the remainder to be a metal salt of sulfamic acid.

The sulfame plating bath in which an organic fluoride material is dispersed should also contain an cationic fluorochemical surface-active agent or an amphoteric fluorochemical surface-active agent capable of exhibiting a cationic nature in the bath. By using at least 0.5 moles of sulfamate ion in combination with the cationic or amphoteric fluorochemical surface-active agent, better electro-codeposition can be carried out with an increased quantity of the organic high-molecular weight fluoride material codeposited. Examples of the cationic or amphoteric fluorochemical surface-active agents include water-soluble ones having a C-F linkage in their molecule, for example, those described in Japanese Patent Application Laid-Open Nos. 52-56026 and 54-159343, alone or in admixture of two or more. Preferred examples are FC-134 and FC-172 manufactured and sold from 3M Corporation and the like. These surface-active agents may preferably be added to the plating bath in amounts of 0.1 to 10 grams, especially 0.3 to 5 grams per liter of the bath. If the amount of the surface-active agent added is below the above-specified range, the organic material is codeposited in a smaller quantity. If the amount is above the range, codeposits are often unsatisfactory. As described above, either the cationic or amphoteric surface-active agent is used, and these surface-active agents may be used alone without the need for an additional surface-active agent, particularly a nonionic surface-active agent. Illustratively, it was known to electrolytically codeposit a water-insoluble organic high-molecular weight fluoride material from a bath containing either one of cationic, amphoteric and nonionic surface-active agents. However, as the use of a single surface-active agent only resulted in a smaller quantity of organic material codeposited, a common practice was to use a cationic surface-active agent combined with a nonionic surface-active agent. By using a combination of sulfamate ion with a cationic or amphoteric fluorochemical surface-active agent, the quantity of organic material codeposited is substantially increased over the conventional methods without the need for coexistence of a nonionic surface-active agent.

It will be understood that the above-described sulfamate plating bath may further contain halides such as nickel chloride and nickel bromide, buffer agents such as boric acid, and commercially available brighteners and other additives. The pH of the plating bath may be preferably adjusted to the acidic range, particularly to the range of pH 3 to 5 for electroplating of nickel and cobalt.

In carrying out codeposition using the plating solution having the metal ion dissolved and the water-insoluble material suspended therein, the solution is circulated and fluidized by means of a pump according to the present invention.

The type of pumps which can be used for circulation and fluidization of a solution is not particularly limited. Some types of pump using a gland packing or mechanical seal may be used as long as entrainment of air bubbles in the fluidized plating solution could be avoided. In this regard, such types of pump, however, are liable to liquid leakage together with water-insoluble materials, and in addition, they would suck in liquid with air entrained as if the liquid was air agitated. For this reason, a seal-free pump, more particularly, a vertical shaft type seal-free pump is best suited for the purpose of the invention.

It is to be noted that the pump itself may be disposed either inside or outside the tank.

The plating solution should be circulated and fluidized at a pumping rate of at least one third of the volume of the bath per minute in order to ensure stable codeposition. If the pumping rate is less than one third of the solution volume per minute, the codeposition process becomes less stable to reduce the quantity of the water-insoluble material codeposited. More preferably, the pumping rate is at least one-half of the total solution volume per minute.

The discharge head of the pump need not necessarily be limited although it may preferably be at least 3 meters, more particularly, at least 5 meters for enhanced fluidization and agitation of the plating solution.

The feature of the present invention is to circulate a plating solution to fluidize it in its tank by pumping a portion of the solution by means of a pump and feeding it back to the solution. The procedure of pumping the plating solution and feeding it back to the tank may be carried out using the preferred system shown in FIGS. 1 to 3. As shown in the figures, one or more sparger pipes 3 are disposed in proximity to the bottom of a plating tank 2 which is filled with an electroplating solution 1 having a water-insoluble material suspended therein. The sparger pipe 3 is perforated with a plurality of holes 4 in its lower side. One end of the sparger pipe 3 is connected to a discharge opening 6 of a pump 5. Then, the pump 5 functions to suck in a portion of the solution 1 and inject it back to the solution 1 through the holes 4 in the sparger pipe 3. On the contrary, direct discharge of the plating solution through the discharge opening of the pump undesirably renders the codeposition process inconsistent to vary and reduce the quantity of the water-insoluble material codeposited.

Figure 2:
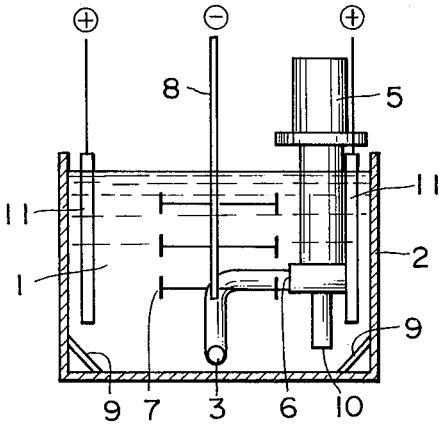
FIG. 2 is a front elevation of the same system, illustrating the tank in cross section.
Figure 3:
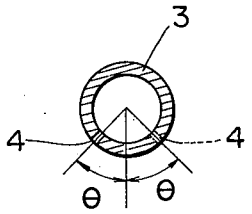
FIG. 3 is an enlarged cross-sectional view of a sparger pipe.

The sparger pipe 3 may preferably be disposed below workpieces 7 to be plated, and more preferably immediately below the workpieces 7 or a rack 8 holding them as shown in FIGS. 1 and 2. In order to thoroughly circulate the plating solution 1 throughout the tank 2 to expose the workpieces 7 immersed therein to evenly fluidized and agitated streams, it is advantageous that the sparger pipe 3 is disposed so as to cover all the workpieces 6 in the tank 2, for example, extends from one end to the opposed end of the tank 2 in its longitudinal, transverse, or diagonal direction.

The holes 4 should be formed in the lower side of the sparger pipe 3 as described above. Provision of the injecting holes 4 in the lower side of the sparger pipe 3 allows the pumped liquid to be injected downward, that is, toward the bottom of the tank 2 and then reflected upward so that the liquid flows past the workpieces 6. Such continuous passage of bath streams across the workpieces ensures uniform and consistent codeposition of the water-insoluble material. Therefore, the workpieces 7 may be positioned in a rather non-limited fashion. If injecting holes are formed in the upper side of the sparger pipe so that the plating solution is injected upward to impinge directly on the workpieces, jets of the solution function to blow codepositing water-insoluble materials away from the workpiece surface, resulting in non-uniform and inconsistent codeposition and reducing the quantity of the water-insoluble material codeposited.

Preferably, the sparger pipe 3 is disposed in proximity to the inside bottom surface of the tank 2, for example, at a distance of 4–20% of the bath depth above the inside bottom surface of the tank 2 such that the plating solution is injected toward the inside bottom surface of the tank 2 through the holes 4. Codeposition is improved by causing streams of the plating solution to be injected through the holes 4 toward the tank bottom and reflected thereby to rise upward. As best shown in FIG. 2, the inside lower corners of the tank 2, at least those corners which extend in a longitudinal direction of the sparger pipe 3 may preferably be bevelled or rounded, for example, by attaching an elongated member 9 to each corner at an angle with respect to the bottom surface. The bevelled or rounded corners facilitate circulation of the plating solution 1 in the tank 2.

Figure 4:
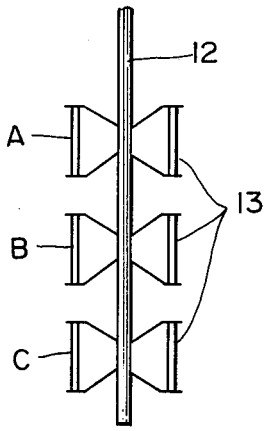
FIG. 4 is a schematic side view showing workpieces (cold rolled steel sheets) mounted on a rack in one experiment of the electro-codeposition method.

The diameter, number, and position of the holes 4 in the sparger pipe 3 are not particularly limited. Preferably, the diameter of the holes 4 is selected such that the cross-sectional area of each hole occupies 0.5% to 3%, especially 0.6% to 2% of the cross-sectional area of the flow path of the sparger pipe 3. Also preferably, the number of the holes 4 is selected such that the total cross-sectional area of the holes occupies 20% to 90%, especially 25% to 75% of the cross-sectional area of the flow path of the sparger pipe 3. More uniform and consistent codeposition is achieved when the diameter and number of the sparger holes 4 fall within the above-specified ranges. Further, the holes 4 may be arranged in a plurality of circumferentially spaced rows (two rows in the figures) in the lower side of the sparger pipe 3 as shown in FIG. 4. Preferably, the holes 4 are formed in an equal number for different rows, and also preferably, at substantially equal intervals.

In injecting the plating solution through the sparger holes 4, it is preferred for stable and sufficient fluidization and agitation to inject the plating solution through the sparger holes 4 at a flow velocity of 1–12 m/sec., especially 3–5 m/sec. and under a discharge pressure of 0.4–5 kg/cm$^2$, especially 0.6–1.2 kg/cm$^2$. A proper flow velocity and discharge pressure may be accomplished by a suitable choice of the pumping capacity and discharge head of the pump, the diameter and number of the sparger holes 4, and the flowpath cross-sectional area of the sparger pipe 3.

It is to be noted that the pump 5 may suck in the plating solution 1 at a suitable site, preferably through a suction opening 10 located near one corner end of the tank 2 as shown in FIG. 2. The plating solution 1 may be sucked in at a plurality of sites, if necessary. Although only one pump is installed in the embodiment illustrated in FIGS. 1 and 2, a plurality of pumps may be installed. If necessary, workpieces may additionally be swung or vibrated although only the fluidization and circulation of the plating solution by means of a pump is the requirement of the present invention. According to the present invention, codeposition is carried out under usual plating conditions as long as the plating solution is thoroughly fluidized as described above. For example, the plating conditions may be set to a temperature of 20° to 80° C. and a cathode current density of 0.1 to 100 A/dm$^2$, preferably 1 to 30 A/dm$^2$ depending on the type of plating baths for electroplating.

As understood from the foregoing, the present invention provides a method for the codeposition of a water-insoluble material with a metal from a plating bath having the metal ion dissolved and the water-insoluble material suspended therein, by pumping at least one third of the volume of the bath per minute by means of a pump without entraining air bubbles, and injecting the thus pumped volume downward into the bath through a plurality of holes in the lower side of a sparger pipe connected to the pump and located at a lower level in a tank, thereby circulating and fluidizing the plating bath in which codeposition is being carried out, with the advantage that the quantity of the water-insoluble material codeposited is increased with a minimal variation, ensuring consistent and uniform codeposition.

In the practice of the invention, the material of which workpieces to be plated are made is not particularly limited and may be any desired material including metals and conductive plastics and fibers. Furthermore, the thickness of codeposits may be suitably selected in accordance with the intended use of plated workpieces, and generally ranges from 1 to 50 microns ($\mu$m).

Depending on the type of water-insoluble material codeposited, workpieces having codeposits formed by the present method may be used in a variety of applications, for example, as slide parts associated with vehicles and precision instruments where wear resistance and low friction are required, as molds for fabricating metallic and non-metallic parts where non-blocking and release properties are required, and as building and living parts, typically kitchenwares, where corrosion resistance and discoloration resistance are required. Codeposits formed by the present method exert their unique nature to a full extent because of their increased quantity of the water-insoluble material codeposited.

The present invention will be more fully understood by referring to the following examples together with a comparative example, but should not be construed as being limited to these examples.

EXAMPLE 1

Using 150 liters of an electroplating bath having the following composition, particles of polytetrafluoroethylene were codeposited with a nickel plating.

| | |
|---|---|
| Plating bath composition | |
| Nickel sulfate | 260 g/l |
| Nickel chloride | 45 g/l |
| Boric acid | 40 g/l |
| Polytetrafluoroethylene | 50 g/l |
| Surface-active agent | 1 g/l |
| Plating condition | |
| Plating temperature | 50° C. |
| Cathodic current density | 4 A/dm$^2$ |
| Anode | electrolytic nickel plate |
| Plating time | 20 minutes |

Using a vertical shaft type seal-free pump, the plating solution was circulated and fluidized at a pumping rate of 30 liters per minute and a discharge head of 5 meters. Injection of the plating solution was carried out by means of the apparatus shown in FIGS. 1–3 in which a sparger pipe having an inner diameter of 18 mm extended at a distance of 2 cm above the bottom of a tank from one end to the opposed end along the longitudinal center line of the tank. The sparger pipe was perforated with forty holes of 2 mm in diameter in two circumferentially spaced rows each including twenty holes, with each hole being oriented to define an angle $\theta$ of 45° in FIG. 3. The solution was injected through the holes at a flow velocity of about 4 m/sec.

The workpieces used were rectangular stainless steel plates of 100 mm by 50 mm. Six plates were held on a rack with three plates on each side as shown in FIGS. 1 and 2, and electroplating was carried out on these plates. Further, as shown in FIG. 2, anodes plates (depicted at 11 in the figure) were placed on opposite sides of the workpieces.

An elongated member was attached at an angle along each of the inside bottom corners of the tank as shown in the figures.

After the completion of plating, codeposit films were separated from the stainless steel plates to determine the quantity of polytetrafluoroethylene particles codeposited.

For the sake of comparison, electro-codeposition was repeated in the same manner as above except that the sparger pipe was removed and the bath was agitated by means of a propeller, and thereafter, the quantity of polytetrafluoroethylene particles codeposited was determined (Comparative Example 1).

The propeller agitation was carried out by means of an agitator equipped with a stainless steel turbine propeller of 55 mm in diameter and its rotational speed was 500 r.p.m.

The results are shown in Table 1.

TABLE 1

| Stainless Steel Plate | Quantity of Particles Codeposited | |
|---|---|---|
| | Example 1 | Comparative Example 1 |
| face | 7.2–9.7 vol % | 1.9–4.2 vol % |
| rear | 6.8–9.4 vol % | 1.5–3.8 vol % |

The numerical values indicate the minimum and maximum of measurements at 18 different sites.

It was also found that the quantity of particles codeposited was reduced when the above-procedure was repeated using a sparger pipe having injecting holes formed in the upper side thereof.

EXAMPLE 2

Using a copper sulfate plating bath having the following composition, electro-codeposition was carried out in the same manner as in Example 1.

| | |
|---|---|
| Plating bath composition | |
| Copper sulfate | 220 g/l |
| Sulfuric acid | 60 g/l |
| Lebco (brightener manufactured by C. Uyemura Co., Ltd.) | 2 mg/l |
| Fluorinated graphite | 50 g/l |
| Surface-active agent | 1 g/l |
| Plating condition | |
| Plating temperature | 25° C. |
| Cathodic current density | 2.5 A/dm$^2$ |
| Anode | phosphorus-containing copper plate |
| Plating time | 15 minutes |

The plating bath was circulated and fluidized at a pumping rate of 30 liters per minute and a discharge head of 5 meters.

The quantity of fluorinated graphite particles codeposited was determined to find that its variation was minimal as in Example 1.

EXAMPLE 3 AND COMPARATIVE EXAMPLES 2 AND 3

Using plating baths having the following compositions, electro-codeposition was carried out on cold rolled steel sheets of 10 cm by 5 cm under the following conditions, and thereafter, the percentage codeposition was determined to obtain the following results.

| | Example 3 | Comparative Example 2 | Comparative Example 3 |
|---|---|---|---|
| Plating Bath Composition | | | |
| Nickel sulfamate | 450 g/l | — | — |
| Nickel sulfate | — | 260 g/l | 260 g/l |
| Nickel chloride | 40 | 45 | 45 |
| Boric acid | 35 | 40 | 40 |

-continued

| | Example 3 | Comparative Example 2 | Comparative Example 3 |
|---|---|---|---|
| Cationic surface-active agent | 1 | 1 | 1 |
| Nonionic surface-active agent | — | — | 0.5 |
| PTFE | 30 | 50 | 50 |
| pH | 4.2 | 4.2 | 4.2 |
| Plating Conditions | | | |
| Temperature | 50° C. | 50° C. | 50° C. |
| Cathode current density | 4 A/dm$^2$ | 4 A/dm$^2$ | 4 A/dm$^2$ |
| Anode | sulfur-containing nickel anode | | |
| Agitation | pump the same as Example 1 | propeller (the same as Example 1) | |
| Deposit | | | |
| Appearance | uniform gray white | non-uniform satin | non-uniform satin |
| Percentage co-deposition of PTFE | 45 vol % | 5 vol % | 9 vol % |

Note:
[1]The cationic surface-active agent used was a perfluoroalkyl trimethyl ammonium salt.
[2]The nonionic surface-active agent used was a perfluoroalkyl ethylene oxide adduct.
[3]PTFE indicates polytetrafluoroethylene.

As seen from the above data, the percentage codeposition is substantially increased by employing the plating method of the present invention.

EXAMPLE 4 AND COMPARATIVE EXAMPLE 4

Using plating baths having the same compositions as used in Example 3 and Comparative Example 3, electro-codeposition was carried out on cold rolled steel sheets under the same conditions, and thereafter, the percentage codeposition was determined.

The volume of the plating bath used was 150 liters, and six cold rolled sheets of 10 cm by 5 cm were mounted on opposite sides of a rack in three (upper, intermediate, and lower) stages as shown in FIG. 4. After plating, the percentage codeposition on the three cold rolled sheets designated A, B, and C was determined (numeral 12 is a rack and 13 designates cold rolled sheets in FIG. 4).

| Percentage Codeposition of PTFE | Example 4 | Comparative Example 4 |
|---|---|---|
| A | 44 vol % | 6.8 vol % |
| B | 42 | 8.5 |
| C | 46 | 9.8 |

As seen from the above data, the plating method of the present invention is affected by agitation to a less extent and accomplishes electro-codeposition with an increased and uniform percentage codeposition.

Anyone skilled in the art will have other modifications occur to him based on the teaching of the present invention. These modifications are intended to be encompassed within the scope of this invention.

What is claimed is:

1. The method for codepositing a water-insoluble material with a metal from a plating solution having the metal ion dissolved and the water-insoluble material suspended therein, characterized by pumping at least one third per minute of the volume of the plating solution by means of a pump without entraining air bubbles, and injecting the thus pumped volume downward into the bath through a plurality of holes in the lower side of a sparger pipe connected to said pump and located at a lower level in a plating tank, thereby circulating and fluidizing the plating solution in which codeposition is being carried out.

2. A codepositing method according to claim 1 wherein said pump is a seal-free pump.

3. The codepositing method according to claim 1 wherein said pump discharges the plating solution at a discharge head of at least 3 meters.

4. The codepositing method according to claim 1 wherein said sparger pipe extends in proximity to the bottom of the tank from one end to the opposed end thereof.

5. The codepositing method according to claim 1 wherein said plurality of holes are formed in the lower side of the sparger pipe at substantially equal intervals, said holes having a diameter such that the cross-sectional area of each hole is 0.5% to 3% of the cross-sectional area of the flow path in said sparger pipe, and the number of said holes is such that the total cross-sectional area of the holes occupies 20% to 90% of the cross-sectional area of the flow path in said sparger pipe.

6. The codepositing method according to claim 1 wherein the plating solution is injected through the sparger holes at a flow velocity of 1 to 12 m/sec. and under a discharge pressure of 0.5 to 5 kg/cm$^2$.

7. The codepositing method according to claim 4 wherein at least the inside lower corners of the tank which extend in a longitudinal direction of the sparger pipe are bevelled or rounded.

8. The codepositing method according to claim 1 wherein said plating solution having said water-insoluble materials dispersed therein is a plating solution containing at least one-half mole of sulfamate ion per liter of the plating solution having a cationic fluorochemical surface-active agent or an amphoteric fluorochemical surface-active agent capable of exhibiting cationic nature in the bath added thereto, and having the water-insoluble organic high-molecular weight fluoride material dispersed therein.

9. The codepositing method according to claim 8 wherein said cationic fluorochemical surface-active agent or amphoteric fluorochemical surface-active agent capable of exhibiting cationic nature in the bath is added in an amount of 0.1 to 10 grams per liter of the bath.

* * * * *